United States Patent [19]

Dielenberg

[11] 4,439,967

[45] Apr. 3, 1984

[54] APPARATUS IN AND RELATING TO BUILDING FORMWORK

[75] Inventor: Olif F. Dielenberg, Victoria, Australia

[73] Assignee: Isorast Thermacell (U.S.A.), Inc., City of Industry, Calif.

[21] Appl. No.: 358,024

[22] Filed: Mar. 15, 1982

[51] Int. Cl.[3] ..... E04C 2/04

[52] U.S. Cl. ..... 52/309.12; 52/421; 52/439; 52/607; 52/593

[58] Field of Search ..... 52/98, 100, 309.12, 52/421, 427, 436, 439, 607, 593

[56] References Cited

U.S. PATENT DOCUMENTS

| | | | |
|---|---|---|---|
| 2,944,162 | 8/1961 | Frantz | 52/421 |
| 3,552,076 | 1/1971 | Gregori | 52/309.12 |
| 4,341,049 | 7/1982 | Hsi | 52/421 |

FOREIGN PATENT DOCUMENTS

| | | | |
|---|---|---|---|
| 1093587 | 5/1955 | France | 52/100 |
| 2394647 | 2/1979 | France | 52/309.12 |
| 985914 | 3/1965 | United Kingdom | 52/98 |
| 1385045 | 2/1975 | United Kingdom | 52/100 |

*Primary Examiner*—Henry E. Raduazo
*Attorney, Agent, or Firm*—Thomas I. Rozsa

[57] ABSTRACT

Improved formwork elements for building purposes. The present invention relates in particular to improved interlocking formwork elements of hollow block configuration produced from a hard foam resin material, and adapted to be filled with concrete to provide a rigid wall or the like having high insulating properties.

5 Claims, 17 Drawing Figures

APPARATUS IN AND RELATING TO BUILDING FORMWORK

BACKGROUND OF THE INVENTION

This present invention relates to formwork elements for building purposes and in particular relates to improved interlocking formwork elements of hollow block configuration produced from a hard foam resin material, and adapted to be filled with concrete to provide a rigid wall or the like having high insulating properties.

Elements of this general type are known for forming a hollow wall permanent formwork adapted to be filled with concrete. With these known elements the transverse walls of the blocks are of equal height to the side walls and cross binding of the filled concrete between adjacent blocks is not possible, resulting in a considerable weakening of the concrete wall. In addition the use of horizontal steel reinforcement is not possible and if the transverse members are located inwardly of the ends of the blocks to allow for cross binding of the concrete, special elements are required to enable a corner connection to be made.

SUMMARY OF THE INVENTION

It has been discovered, according to the present invention, that a vastly improved building formwork element is achieved through the use of lightweight insulating material comprising a hollow block member having side walls and end walls with mating grooves and tongues along the upper and lower edges of the side walls for interlocking purposes, said end walls having upper and lower cut-out portions receiving removable inserts to close off said end walls at corner, wall end and T-connections.

The inserts are preferably of tongue and groove form for interlocking purposes with mating tongues and grooves in said cut-out portions.

It has further been discovered, according to the present invention, that the building formwork element is further improved if there is provided transverse cross pieces in the block between the end walls, said transverse cross pieces also having upper and lower cut-out portions adapted to receive removable inserts.

It has additionally been discovered, according to the present invention, that the improved building formwork element is enhanced if it is manufactured from a hard foamed resin material such as polystyrol or the like.

It is therefore an object of the present invention to provide an improved formwork block for construction purposes having end transverse walls allowing strong cross binding of the concrete, and eliminating the requirement for special elements for the interlocking of corner connections, T-connections, wall connections and wall end closures.

It is a further object of the present invention to provide an improved formwork block for construction purposes wherein the block further contains transverse cross pieces between the end walls of the block for the dual purposes of strengthening the block and enabling a worker to cut the block into shorter fewer cavity blocks.

It is an additional object of the present invention to provide an improved formwork block which eliminates the necessity of using a number of different size and shape blocks for building formwork and permits a single size and shape building formwork block to be used for providing all wall connections, T-connections, corner connections and wall end closures, and further allowing the installation of vertical and horizontal steel reinforcement in the construction of a buliding.

Further novel features and other objects of the present invention will become apparent from the following detailed description, discussion and the appended claims, taken in conjunction with the drawings.

DRAWING SUMMARY

Referring particularly to the drawings for the purposes of illustration only and not limitation there is illustrated:

DETAILED DESCRIPTION OF THE PREFERRED EMBODIMENT

Figures 1, 2, 3:
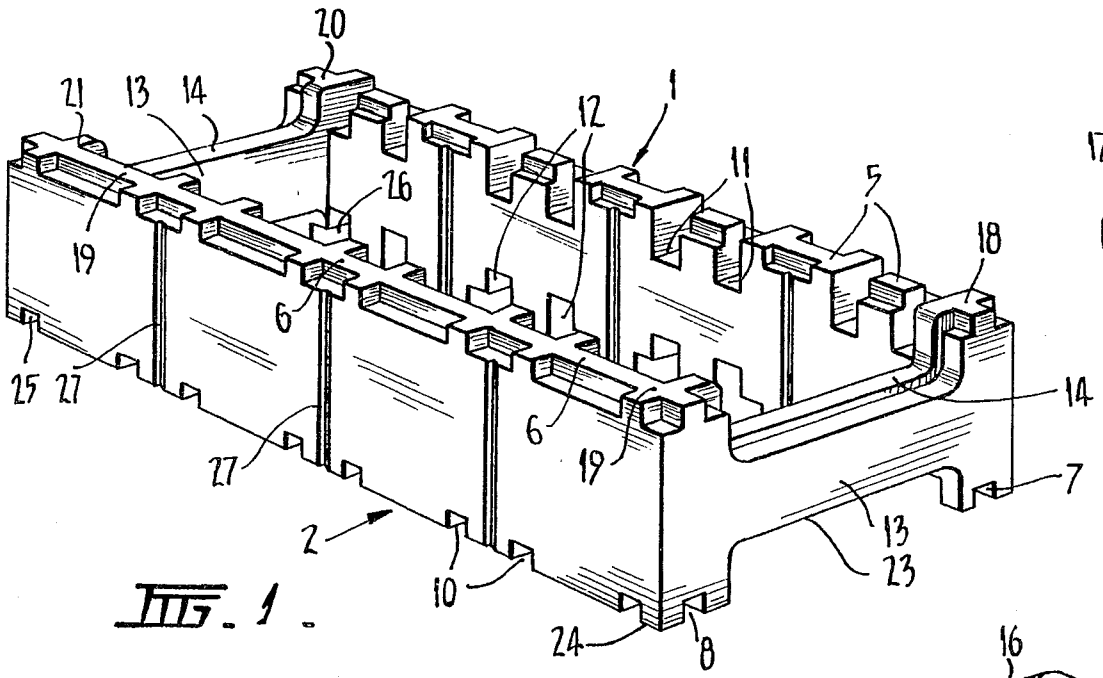
FIG. 1 is a perspective view of one embodiment of the Improved Building Formwork Block of the present invention.
FIG. 2 is a perspective view of an insert for the upper part of an end wall of the present invention.
FIG. 3 is a perspective view of an insert for the lower part of an end wall of the present invention.

With reference to the drawings of the invention in detail and more particularly to FIG. 1, there is illustrated one embodiment of the Improved Building Formwork Block of the present invention. The form element or block of FIG. 1 comprises side walls 1 and 2, each provided at the top thereof with longitudinal ridge bearers 5 and 6, corresponding cross ridge bearers 18, 19, 20 and 21 matching longitudinal mortised key seats 7 and 8, and corresponding cross mortises 10, 11, 12, 23, 24, 25 and 26.

Side walls 1 and 2 are joined at their ends by connecting members 13 provided at their upper edge with an upstanding ridge member 14 a tongue and groove at said upper edge which corresponds with the tongue and groove 15, 17 of an insert illustrated in FIG. 2 which when inserted into the butt end of the block provides a continuous and interlocking corner and end connection with cross ridge bearers 18, 19, 20 and 21 at the top.

The other insert illustrated in FIG. 3 is provided with a groove 22, which on insertion into the butt end of the form element, provides a continuous and interlocking corner and end connection with cross mortises 23, 24, 25 and 26 at the bottom.

The inner and outer surfaces of side walls 1 and 2 and provided with vertical grooves 27 which allow for accurate cutting of the block into quarter pieces.

Figure 4:
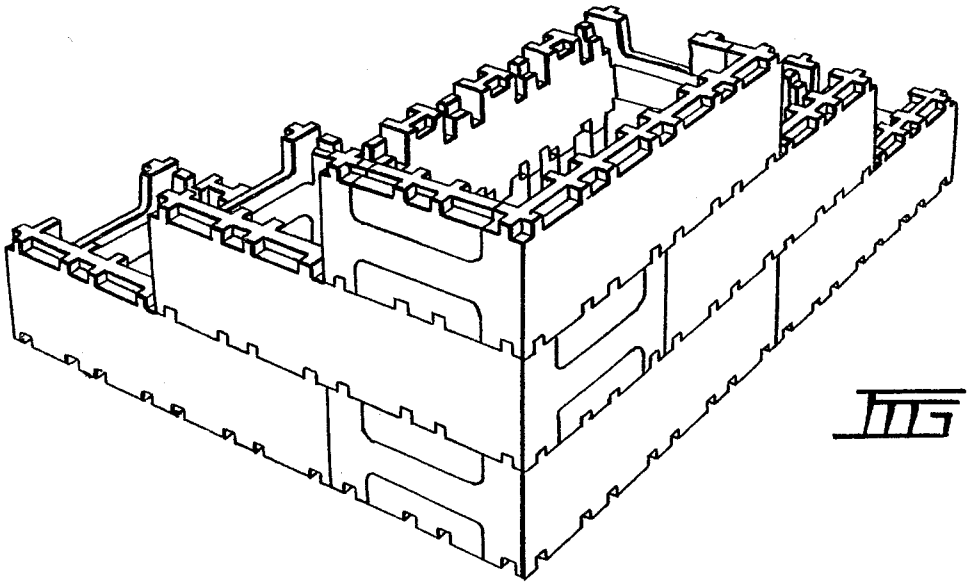
FIG. 4 is a perspective view of a corner connection in a formwork wall illustrating the use of the Improved Building Formwork Block, and the inserts in the upper and lower part of the end wall.

There is shown in FIG. 4 a perspective view of a corner connection in a formwork wall illustrating the use of the Improved Building Formwork Block of FIG. 1 and the inserts in the upper and lower parts of the end wall illustrated in FIGS. 2 and 3 respectively as part of the structure of a building.

Figure 5:
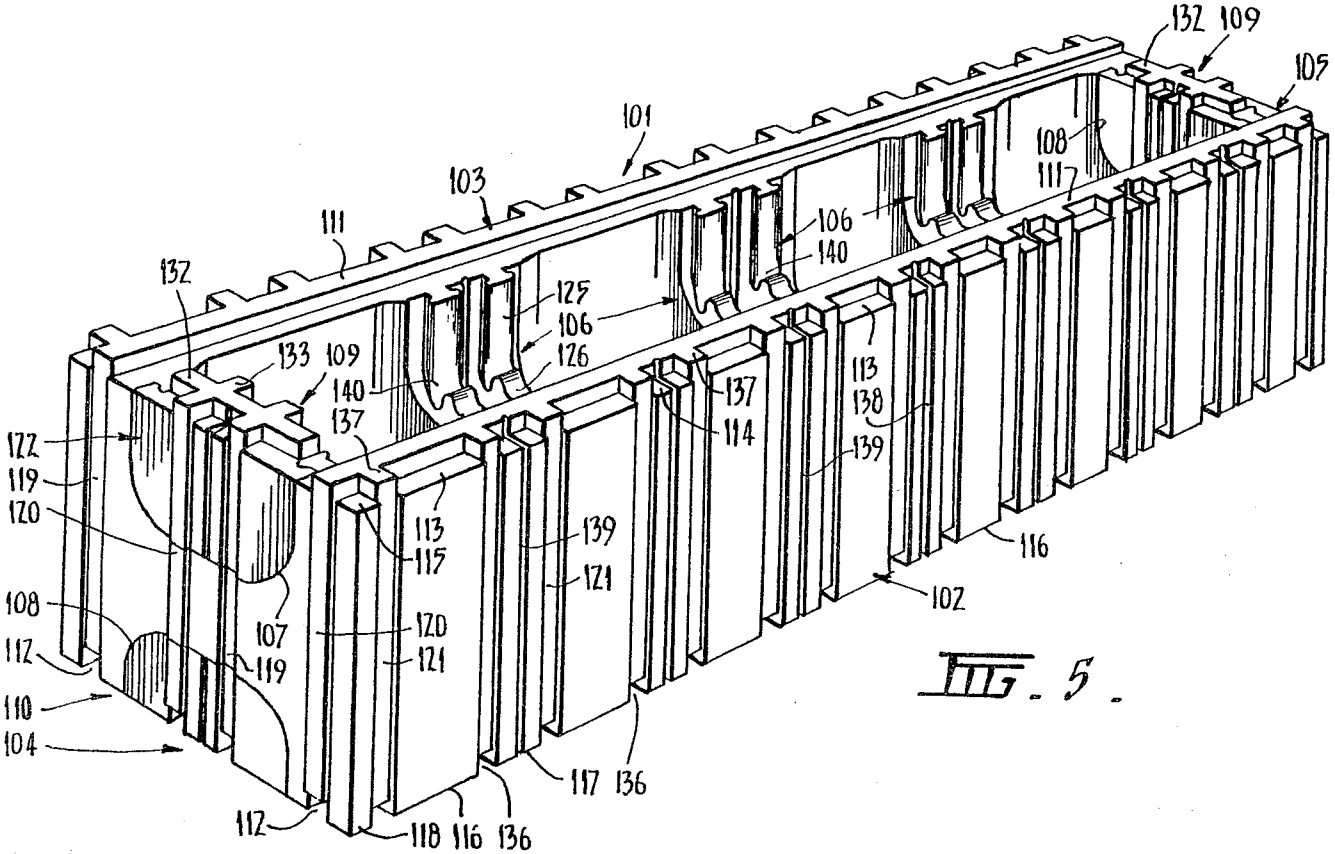
FIG. 5 is a perspective view of a second embodiment of the Improved Building Formwork Block of the present invention.
Figure 6:
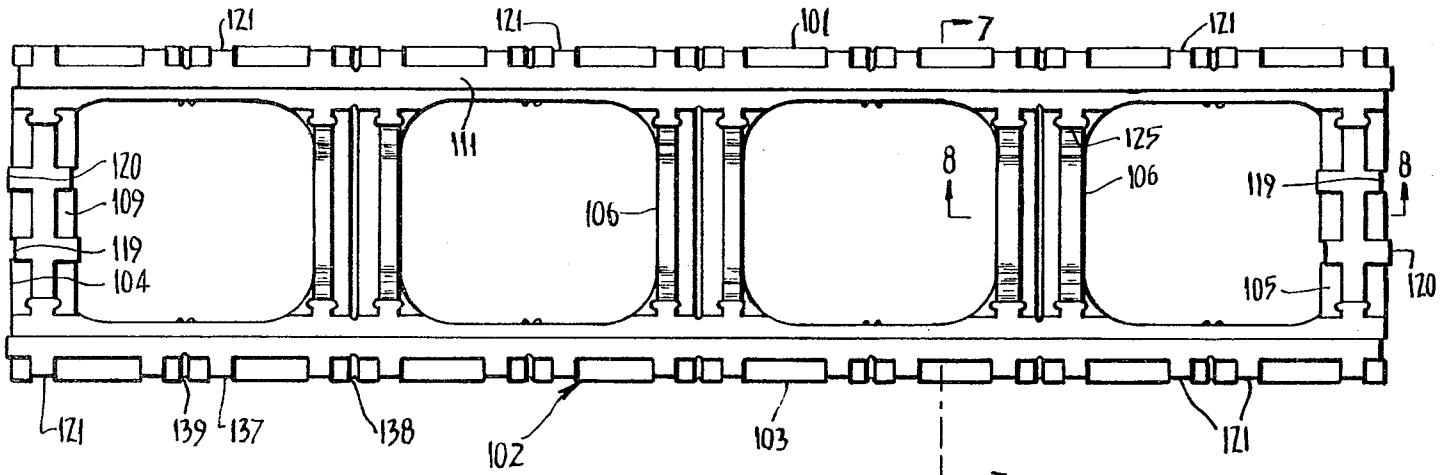
FIG. 6 is a top plan view of the embodiment of the Improved Building Formwork Block illustrated in FIG. 5.

With reference to the drawings of the invention in detail and more particularly to FIG. 5, there is illustrated a second embodiment 101 of the Improved Building Formwork Block of the present invention. The form element 101 illustrated is a multi-cavity element having side walls 102 and 103, end walls 104 and 105 and transverse walls 106 located between the end walls. End walls 104 and 105 have cut-out portions 107 and 108 and include insert members 109 and 110 removably located in said cut-out portions. Transverse walls 106 are thicker than end walls 104 and 105 and take the form of two end walls moulded back to back for reasons and for the purpose hereinafter described.

Figure 7:
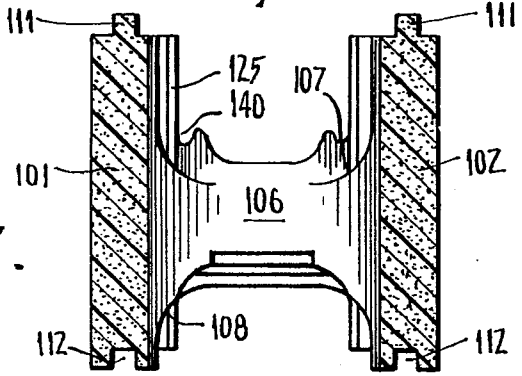
FIG. 7 is a cross-sectional view of the Improved Building Formwork Block taken along line 7—7 of FIG. 6.

Referring to FIGS. 5 and 7, in order that elements 101 can be assembled in interlocking form, top and bottom, the side walls 102 and 103 are provided at their upper end with continuous longitudinal ridge 111 which mates with continuous longitudinal slot 112 on the underside of the walls and slots 113, 114 and 115 on the upper end mate with tongues 116, 117 and 118.

Referring to FIGS. 5 through 8, in order that elements 101 can be assembled in interlocking form, top and bottom, the side walls 102 and 103 are provided at their upper end with continuous longitudinal ridge 111 which mates with continuous longitudinal slot 112 on the underside of the walls and slots 113, 114 and 115 on the upper end mate with tongues 116, 117 and 118.

Referring to FIGS. 5 through 8, in order to locate and match the elements 101 in end to end relationship, end wall 104 is provided with vertical grooves 119 and vertical ribs 120 mating with corresponding grooves and ribs in wall 105. For end to side location of the elements, ribs 120 mate with grooves 121 in side walls 102 and 103.

Figure 9:
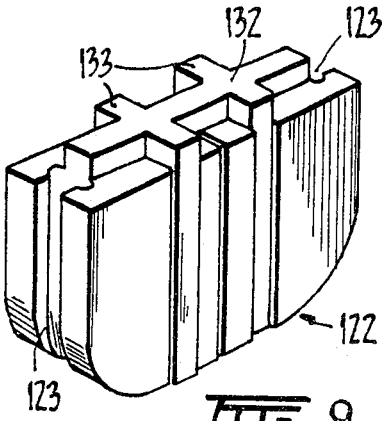
FIG. 9 is a perspective view from one side of an insert for the upper part of an end wall for the embodiment of the Improved Building Formwork Block illustrated in FIG. 5 and 6.
Figure 10:
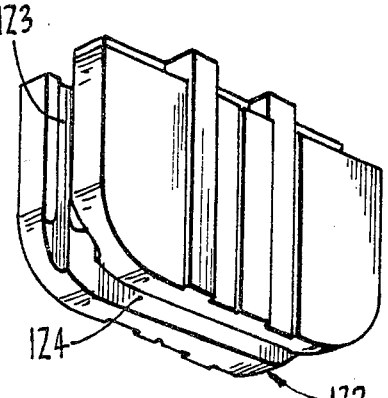
FIG. 10 is a perspective view from the opposite side of the insert for the upper part of an end wall for the embodiment of the Improved Building Formwork Block illustrated in FIG. 5 and 6.

The upper end wall insert 122 illustrated in FIGS. 9 and 10 is provided with vertical slots 123 and transverse slot 124 mating with vertical ribs 125 and horizontal transverse rib 126 respectively in the end walls 104 and 105.

Figure 11:
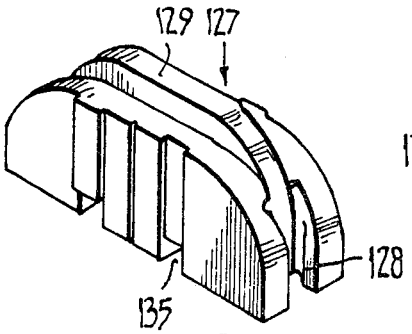
FIG. 11 is a perspective view from one side of an insert for the lower part of an end wall for the embodiment of the Improved Building Formwork Block illustrated in FIGS. 5 and 6.
Figure 12:
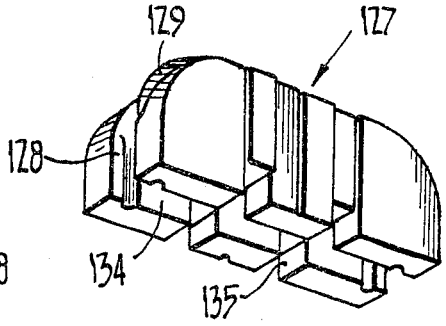
FIG. 12 is a perspective view from the opposite side of the insert for the lower part of an end wall for the embodiment of the Improved Building Formwork Block illustrated in FIG. 5 and 6.

The lower end wall insert 127 illustrated in FIGS. 11 and 12 is provided with vertical slots 128 and transverse rib 129 mating with vertical ribs 130 and groove 131 respectively in the end walls 104 and 105.

Both inserts 122 and 127 are provided with ribs and grooves to line up with the ribs 120 and grooves 119 on the end walls. Upper insert 122 is provided with a transverse rib 132 and longitudinal ribs 133 for interlocking with transverse grooves 134 and longitudinal grooves 135 in lower insert 127 when the elements are interlocked in top and bottom fashion.

For cross or T-connections with one element above another, transverse grooves 136 extending across the bottom edge of side walls are adapted to engage over ridges 111 and rib 132 of insert 122. Slots 112 and grooves 135 are adapted to engage over projections 137 at the upper edge of side walls 102 and 103.

Figure 8:
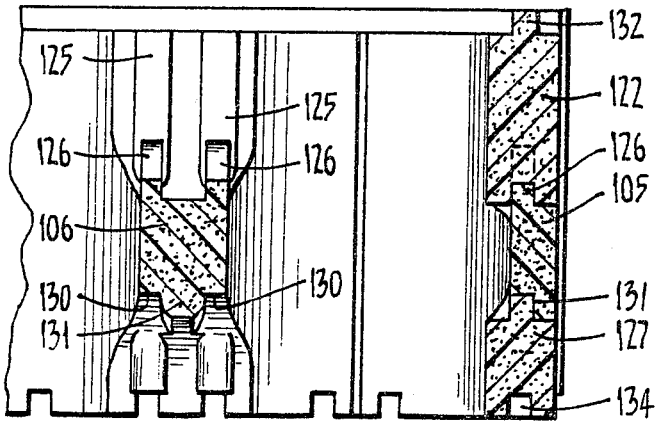
FIG. 8 is a cross-sectional view of the Improved Building Formwork Block taken along line 8—8 of FIG. 6.

As will be seen from FIGS. 5 and 8, the transverse walls 106 are provided, in duplicate, with similar ribs and grooves as in the end walls for receiving the upper and lower inserts.

By providing the transverse walls 106 in the configuration shown, if for example a three cavity element is required, the element can be cut or sawn through the middle of a transverse wall and the half of the cut transverse wall left on the three cavity element constitutes an end wall similar to end walls 104 and 105. Similarly with the single cavity element left after cutting. Grooves 138 are provided in the side walls 102 and 103 as a guide for cutting the elements. Grooves 139 are also provided on the side walls as a guide if the element is to be cut to provide an open ended half cavity at one end thereof.

In use, in the construction of a building, the elements or blocks of the invention are set out on a concrete slab foundation preferably to 3 course or row height will all elements interlocking or abutting to delineate rooms, doors, windows, vents and the like. Concrete is then poured into the elements or blocks and allowed to set and further elements are added and filled until total room height has been reached. It is preferable to insert vertical reinforcing rods into the concrete slab so as to extend through the cavities of the elements and horizontal reinfrocing rods can be conveniently located in grooves 140 in the end and transverse walls and tied to the vertical reinforcing rods.

In order to allow for a good crossbinding of the concrete fill along the walls, the inserts 122 and 127 are removed and this also allows use of extended lengths of horizontal reinforcement. The inserts 122 and 127 must be used at corners or wall ends or in some cases at butt joints, to provide a full wall surface and of course to prevent the concrete running out. Preferably a filling rail should be located over the top of the elements on each side to prevent the concrete entering the grooves and slots on the top of the elements. This will make the placing of subsequent elements much easier.

Large diameter pipes for plumbing and carrying electrical cables may be located in the elements before filling, and being fully embedded in the concrete a soundproofing effect is obtained. Small diameter pipes can be set into the sides of the elements by cutting a groove therein such as by using a soldering gun hot wire bent to U-shape. This is most advantageous with hot water pipes in view of the excellent insulation properties of the material of the elements.

The outside surfaces of the walls formed can be faced with bricks, cement rendering or plaster reinforced with fibre glass. Bricks can be laid directly on to the elements as the non-capilliary and high insulation properties of the elements obviates the requirement of a cavity between brick and wall. Brick ties can be pushed into the elements just after filling.

The inside surfaces may be faced with plaster board, tiles, timber panelling and the like.

By providing walls of the material of the elements, most effective insulation properties are obtained. Equally there is exceptional soundproofing. The preferred material, polystyrol, is a non-combustable and self extinguishing material.

Figure 13:
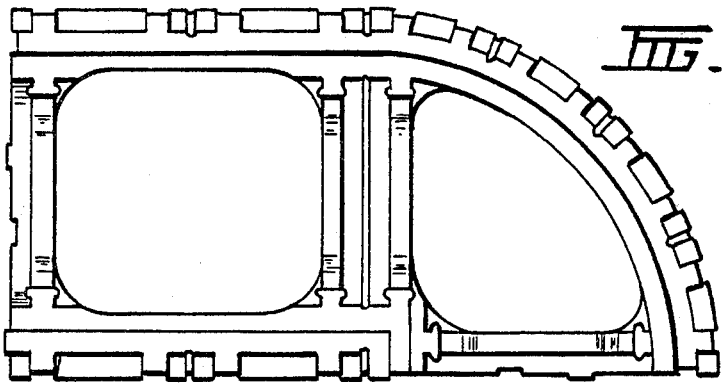
FIG. 13 is a top plan view of a curved corner element or block for use in the Improved Building Formwork Block illustrated in FIG. 5 and 6.

Referring to FIG. 13 there is illustrated an element or block for use on curved corners or doorways of buildings. The element or block of this embodiment has similar constructional and interlocking features as the element or block of FIGS. 5 to 12. The curved outer surface of this element or block is provided with a number cutting guide grooves so that a curved part having less than 90° can be obtained.

Figure 15:
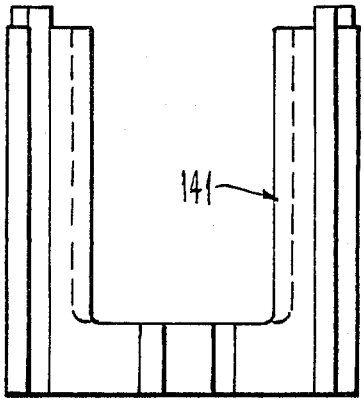
FIG. 15 is an end view of a lintel element or block for use with the Improved Building Formwork Block illustrated in FIG. 5 and 6.
Figure 14:
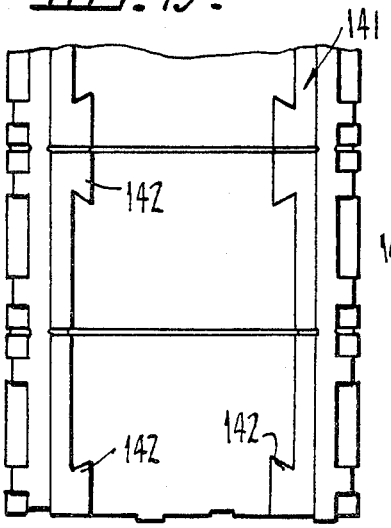
FIG. 14 is a top plan view of a lintel element or block for use with the Improved Building Formwork Block illustrated in FIG. 5 and 6.

FIGS. 14 and 15 illustrate another embodiment of the invention wherein the element or block comprises a lintel member having the upper and side parts of the side members similar in form to the element or block of FIGS. 5 to 12, but including a closed bottom 141 and dovetail shaped ribs 142, to enhance locking of the concrete therein, and no transverse walls. In use this lintel member is set across a door opening on top of existing wall elements and supported while being filled with concrete. The lintel element is dimensioned so that further courses or levels of the basic formwork elements can be added thereto and interlocked by reason of the mating configuration of the upper edge of the lintel side member.

Figure 17:
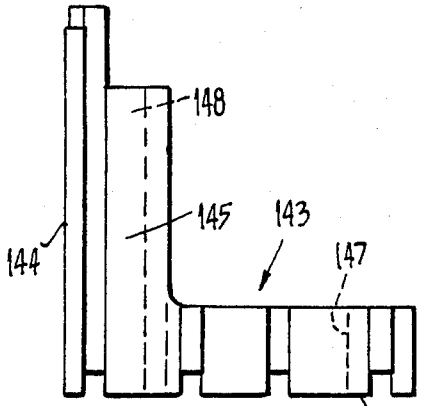
FIG. 17 is an end view of a ceiling edge element or block for use with the Improved Building Formwork Block illustrated in FIG. 5 and 6.
Figure 16:
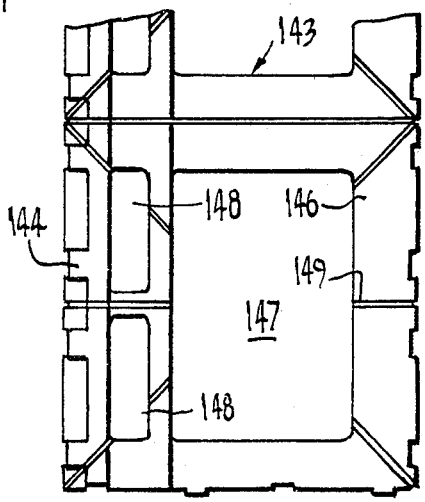
FIG. 16 is a top plan view of a ceiling edge element or block for use with the Improved Building Formwork Block illustrated in FIG. 5 and 6.

FIGS. 16 and 17 illustrate a ceiling edge element or block 143 which is used at room height level to support a concrete plate or plates forming a ceiling. The side wall 144 is of similar configuration to the element or block of FIGS. 5 to 12 as is the top edge of side wall 144, the lower part 145, and the bottom part 146 has grooves and ribs to allow interlocking with a basic element. The bottom part 146 has cavities 147 and 148 which are filled with concrete. In use this ceiling edge element or block is interlocked on the walls constituted by the basic elements of FIGS. 5 to 12 and after the concrete filling has set, the ceiling plate or plates is or are placed in position resting on the ledge afforded by element 143. Support members are located throughout the area of the ceiling plates and a further concrete fill is made up to the top of side wall 144. Reinforcement members can be inserted in the concrete fill.

After the concrete fill has set, further floors of the building can be developed in like manner to the first floor and the basic formwork elements can be interlocked and be built up from the side wall 144 of the ceiling edge member and the concrete fill therein.

As shown in FIG. 16 grooves 149 are formed in the element as a guide to cutting, the diagonal grooves allowing for accurate cutting of mitred ends of the element.

The elements or blocks as defined in FIGS. 1 through 16 are used to build structures such as a commercial or residential building.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown in intended only for illustration and for disclosure of an operative embodiment, and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A building block formwork element to be used in building a structure, comprising:

a. a hollow rectangular shaped block member having first and second oppositely disposed parallel side walls and first and second oppositely disposed parallel end walls;

b. said first side wall containing a multiplicity of mating grooves and ribs which extend along the height of the wall;

c. said second side wall containing a multiplicity of mating grooves and ribs which extend along the height of the wall;

d. said first end wall containing a multiplicity of mating grooves which extend along the height of the wall;

e. said second end wall containing a multiplicity of ribs which extend along the height of the wall and correspond to the multiplicity of mating grooves in the first end wall;

f. said second end wall containing a multiplicity of mating grooves which extend along the height of the wall;

g. said first end wall containing a multiplicity of ribs which extend along the height of the wall and correspond to the multiplicity of mating grooves in the second end wall;

h. the ribs and grooves in said first and second end wall also corresponding to selected grooves and ribs in said first and second side walls;

i. said first end wall containing an upper arcuate cut-out portion extending downwardly from its top and a lower arcuate cut-out portion extending upwardly form its bottom;

j. said second end wall containing an upper arcuate cut-out portion extending downwardly from its top and a lower arcuate cut-out portion extending upwardly from its bottom;

k. a first upper removable insert member corresponding to the upper arcuate cut-out portion of said first end wall and removably inserted therein;

l. a first lower removable insert member corresponding to the lower arcuate cut-out portion of said first end wall and removably inserted therein;

m. a second upper removable insert member corresponding to the upper arcuate cut-out portion of said second end wall and removably inserted therein;

n. a second lower removable insert member corresponding to the lower arcuate cut-out portion of said second end wall and removably inserted therein;

o. the top of said first side wall containing a longitudinal ridge extending the length of the wall;

p. the bottom of said first side wall containing a longitudinal groove extending the length of the wall and corresponding to the ridge on the top of the wall;

q. the top of said second side wall containing a longitudinal ridge extending the length of the wall;

r. the bottom of said second side wall containing a longitudinal groove extending the length of the wall and corresponding to the ridge on the top of the wall;

s. the top of said first side wall containing a multiplicity of slots adjacent its exterior surface;

t. the bottom of said first side wall containing a multiplicity of tongues adjacent its exterior surface and corresponding to the slots at the top of the wall;

u. the top of said second side wall containing a multiplicity of slots adjacent its exterior surface;

v. the bottom of said second side wall containing a multiplicity of tongues adjacent its exterior surface and corresponding to the slots at the top of the wall;

w. the outwardly facing wall of said first upper removable insert member containing ribs and grooves in alignment with the ribs and grooves in said first end wall;

x. the outwardly facing wall of said first lower removable insert member containing ribs and grooves in alignment with the ribs and grooves in said first end wall;

y. The outwardly facing wall of said second upper removable insert member containing ribs and grooves in alignment with the ribs and grooves in said second end wall;

z. the outwardly facing wall of said second lower removable insert member containing ribs and grooves in alignment with the ribs and grooves in said second end wall;

aa. the top of said first upper removable insert member containing ribs extending along the width of the top and along the thickness of the top;

bb. the bottom of said first lower removable insert member containing grooves along the width of the bottom and along the thickness of the bottom to correspond with the ribs at the top of the first upper insert member;

cc. the top of said second uper removable insert member containing ribs extending along the width of the top and along the thickness of the top;

dd. the bottom of said second lower removable insert member containing grooves along the width of the bottom and along the thickness of the bottom to correspond with the ribs at the top of the second upper insert member;

ee. the arrangement of ribs and grooves in the first and second side walls, first and second end walls, first and second upper removable insert members, and the first and second lower removable insert members being arranged so that adjacent blocks can be interlocked end to end, end to side, in complete alignment with top to bottom or offset in alignment with a portion of the bottom interlocked with each of two adjacent tops;

ff. said hollow rectangular shaped block further comprising a multiplicity of transverse walls disposed between said first and said second side walls to thereby form a multiplicity of chambers within the block;

gg. each of said transverse walls containing an upper arcuate recess corresponding to the upper arcuate recess in the first and second end walls;

hh. each of said transverse walls containing a lower arcuate recess corresponding to the lower arcuate recess in the first and second end walls; and ii. said first and second end walls and said transverse walls containing aligned grooves in their upper arcuate recess portions.

2. The building block formwork element as defined in claim 1 wherein each transverse wall member constitutes two end walls molded back to back so that when a block is cut through said transverse wall member, the open ends formed may be closed off by an upper insert member and a lower insert member so as to provide two or more closed end smaller blocks.

3. The invention as defined in claim 1 wherein said hollow block formwork element is made of lightweight insulating material.

4. The invention as defined in claim 1 wherein said hollow block formwork element is made of hard foamed resin.

5. The invention as defined in claim 4 wherein said hard formed resin material is polystyrol.

* * * * *